US008365437B2

(12) United States Patent
Lee et al.

(10) Patent No.: US 8,365,437 B2
(45) Date of Patent: Feb. 5, 2013

(54) DRUM FOR WASHER AND DRYER

(75) Inventors: Soon Jo Lee, Gyeongsangnam-do (KR); In Hee Han, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1764 days.

(21) Appl. No.: 10/528,830

(22) PCT Filed: Jun. 3, 2004

(86) PCT No.: PCT/KR2004/001316

§ 371 (c)(1),
(2), (4) Date: Mar. 23, 2005

(87) PCT Pub. No.: WO2004/109004

PCT Pub. Date: Dec. 16, 2004

(65) Prior Publication Data

US 2006/0005585 A1 Jan. 12, 2006

(30) Foreign Application Priority Data

Jun. 5, 2003 (KR) ..... 10-2003-0036393
Jan. 17, 2004 (KR) ..... 10-2004-0003532

(51) Int. Cl.
*F26B 25/16* (2006.01)
*F26B 11/02* (2006.01)

(52) U.S. Cl. ..... 34/602

(58) Field of Classification Search ..... 34/108, 34/499, 318, 601, 602, 603, 242; 68/20, 68/142

See application file for complete search history.

(56) References Cited

U.S. PATENT DOCUMENTS

| | | | | |
|---|---|---|---|---|
| 1,645,971 | A * | 10/1927 | Riegel | 72/370.08 |
| 3,399,464 | A | 9/1968 | Erickson et al. | |
| 3,584,393 | A | 6/1971 | Menk | |
| 3,685,338 | A * | 8/1972 | Hoffman | 72/348 |
| 3,686,338 | A | 8/1972 | Vecchio et al. | |
| 3,789,514 | A | 2/1974 | Faust et al. | |
| 3,815,258 | A | 6/1974 | Beard, Jr. | |
| 3,816,942 | A | 6/1974 | Smith | |
| 3,946,500 | A | 3/1976 | Barrett et al. | |
| 4,430,809 | A | 2/1984 | Jackson et al. | |
| 4,446,035 | A * | 5/1984 | Barrat et al. | 510/335 |
| 4,547,269 | A | 10/1985 | Rausch et al. | |

(Continued)

FOREIGN PATENT DOCUMENTS

| | | |
|---|---|---|
| CN | 2443979 | 8/2001 |
| DE | 3227853 | 1/1984 |

(Continued)

OTHER PUBLICATIONS

Collins English Dictionary—Complete and Unabridged. HarperCollins Publishers, 2003, entry: Butt Joint, accessed at http://www.thefreedictionary.com/butt+joint.*

(Continued)

*Primary Examiner* — Joseph L Perrin
(74) *Attorney, Agent, or Firm* — McKenna Long & Aldridge LLP

(57) ABSTRACT

Drum (1) for a washing machine or a dryer including a cylindrical metal body part (100). reduced parts (110) at opposite ends of the body part, each having a diameter smaller than a diameter of the body part. and bent parts (120) each having a folded edge of the reduced part, thereby providing a drum that preventing occurrence of vibration and noise.

9 Claims, 13 Drawing Sheets

U.S. PATENT DOCUMENTS

| | | | | |
|---|---|---|---|---|
| 4,687,614 | A * | 8/1987 | Suzuki et al. | 264/40.1 |
| 4,781,301 | A | 11/1988 | Le Bret et al. | |
| 4,854,054 | A * | 8/1989 | Johnson | 34/603 |
| 5,063,098 | A * | 11/1991 | Niwa et al. | 428/76 |
| 5,127,169 | A | 7/1992 | Ellingson | |
| 5,246,563 | A | 9/1993 | Maresch et al. | |
| 5,324,595 | A | 6/1994 | Rosen | |
| 5,326,648 | A | 7/1994 | Kato et al. | |
| 5,571,566 | A | 11/1996 | Cho | |
| 5,901,465 | A * | 5/1999 | Boussetta et al. | 34/602 |
| 5,950,472 | A | 9/1999 | Grotnes et al. | |
| 6,062,049 | A * | 5/2000 | Martinsson | 68/140 |
| 6,206,986 | B1 | 3/2001 | Brisberger | |
| 2002/0189070 | A1 | 12/2002 | Noel et al. | |

FOREIGN PATENT DOCUMENTS

| | | | |
|---|---|---|---|
| EP | 0234243 | | 9/1987 |
| FR | 2530536 | | 1/1984 |
| FR | 2667521 | | 4/1992 |
| GB | 20898 | | 0/1907 |
| GB | 136510 | | 12/1919 |
| GB | 283673 | | 1/1928 |
| GB | 399132 | | 9/1933 |
| GB | 1059002 | | 2/1967 |
| JP | 53-116267 | | 10/1978 |
| JP | 56-033138 | | 4/1981 |
| JP | 58-016781 | | 1/1983 |
| JP | 03-018439 | | 1/1991 |
| JP | 06-199591 | | 7/1994 |
| JP | 7112792 | | 5/1995 |
| JP | 11-342429 | | 12/1999 |
| JP | 2001276905 | | 10/2001 |
| JP | 2002302753 | | 10/2002 |
| JP | 2002327257 | | 11/2002 |
| JP | 2002332557 | | 11/2002 |
| KR | 870001106 | | 6/1987 |
| KR | 960006021 | | 5/1996 |
| KR | 960011022 | | 8/1996 |
| KR | 100358938 | | 10/2002 |
| KR | 20030032323 | | 4/2003 |
| KR | 10-2003-0049444 | | 6/2003 |
| NL | 7807744 | | 1/1980 |
| WO | WO 94/27280 | | 11/1994 |
| WO | WO 03/008696 | * | 1/2003 |
| WO | WO03/008696 | | 1/2003 |

OTHER PUBLICATIONS http://inventors.about.com/od/wstartinventions/a/washingmachines_2.htm, "History of Clothes Dryers," Mary Bellis, 2007 About.com, Inc. New York Times Company.

"Il Nuovo Zingarelli Vocabclariodella Lingua Italiana," 1988, pp. 2188-2189; and G. Marolli, "Dizionario Technico-Technical Dicitionar," 1991, p. 1915 and Wikipedia, The Free Encyclopedia, http://en.wikipedia.Ol:g/wikilPlaLing.

"Tool and Manufacturing Engineers Handbook"; Society of Manufacturing Engineers; vol. 2, ch. 7, pp. 7-11 to 7-13, 4th Ed. SME, 1998 (http://books.google.it/books/about/ToolandManufacturingEngineersHandboo.Html?id=9ty5NPJ0UI4C&redir_esc=y).

* cited by examiner

DRUM FOR WASHER AND DRYER

TECHNICAL FIELD

This application is a National Stage Entry of International Application No. PCT/KR2004/01316, filed Jun. 3, 2004, and claims the priority benefit of Korean Application No. P2003-0036393 filed on Jun. 5, 2003 and Korean Application No. P2004-0003532 filed on Jan. 17, 2004, the contents of which are hereby incorporated by reference in their entirety.

The present invention relates to drums for washers or dryers, and more particularly, to a drum which can prevent occurrence of noise and vibration.

BACKGROUND ART

In general, the dryer is an apparatus for drying a drying object, such as clothes introduced into a drum with hot air heated by an electric heater, a gas burner, or the like, of which demand keeps increasing, recently.

FIG. 1 illustrates a disassembled perspective view of a related art dryer.

Referring to FIG. 1, the related art drum 1 is provided inside of a cabinet (not shown) that forms an exterior of the dryer. The drum 1 is cylindrical with opened front and rear, having a belt groove 2 along an outside circumferential surface for winding a belt (not shown) connected to a motor or the like.

The drum 1 has a chamber 5 for holding the drying object therein, with a plurality of lifts 6 each projected a length from an inside circumferential surface of the chamber 5, for lifting/dropping the drying object during rotation of the drum 1, to turn the drying object upside down, for fast drying of the drying object.

The drum 1 is provided with a front supporter 7 and a rear supporter 9 to a front and a rear thereof, respectively. The front supporter 7 and the rear supporter 9 close as well as support the front and the rear of the chamber 5, respectively.

There are sealing member 10 between the front supporter 7/the rear supporter 9 and the drum 1 for preventing leakage of water. The front supporter 7 and the rear supporter 9 are provided with a plurality of rollers (not shown) in alignment with the front and the rear of the drum 1 for supporting the drum 1, respectively.

The front supporter 7 has an opening 8 for making the chamber 5 in communication with an outside of the chamber 5. The opening 8 is opened/closed by a door, selectively. The rear supporter 9 is provided with a supply duct 12 in communication with the chamber 5 as a passage for supplying hot air to the chamber 5.

There is an outlet assembly 13 at one side of the front supporter 7 under the opening 8 in the front supporter 7 as a passage for escaping of air from the chamber 5. The outlet assembly 13 has a filter 14 fitted thereto. The filter 14 removes foreign matters (for an example, thread wastes, or dust) from the air escaping from the chamber 5.

The outlet assembly 13 is in communication with an exhaust duct 15, having the filter 14 positioned at an inlet thereof. The exhaust duct 15 is connected to a fan housing 18 for flow of air from the chamber 5 to the exhaust duct 15 and the fan housing 18 as a fan 17 in the fan housing 18 comes into operation. It is preferable that the fan 5 is a centrifugal fan for effective use of a space, but an axial fan is also acceptable.

The fan housing 18 has one side in communication with the exhaust duct 15, and the other side connected to the exhaust pipe 19. According to this, air passed through the fan housing 18 is discharged to an outside through an exhaust pipe 19.

In the meantime, the supply duct has an inlet in communication with a guide funnel 16. The guide funnel 16 has a form of a truncated cone for guiding the hot air produced by burning the gas toward the inlet of the supply duct.

There is a gas burning device 20 provided to the inlet of the guide funnel 16. The gas burning device 20 is provided with a valve, a mixing tube, and an igniter. The valve, connected to a gas pipe, controls supply of gas. The mixing tube mixes the gas sprayed from the gas nozzle with the air, and the igniter ignites the mixed gas.

In the meantime, the drum applied to the dryer is fabricating by the following process in the related art.

Referring to FIG. 2, at first, thin metal plate of such as stainless steel is rolled into a cylinder and a seam thereof is welded. Next, a diameter of a middle part of the cylindrical drum is expanded, leaving both ends as they are. In this instance, the middle part of the drum is expanded as dies provided to an inside thereof press assigned areas of an inside circumferential surface of the drum, outwardly.

Then, beads are formed in the middle part of the expanded drum. That is, a plurality of thin grooves are form along an outside circumferential surface of the drum, for strengthening the drum. Also, front and rear edges of the drum are hemmed.

However, the related art method for fabricating the drum has the following problems.

In the related art method for fabricating a drum, the middle part of the drum is expanded by pressing the inside circumferential surface of the middle part of the drum with the dies. Therefore, after finishing fabrication of the drum, traces of the dies remain on the drum, resulting in a poor outer appearance. Also, as a circular shape of the drum is impaired, the drum fails to have uniform rotation inertia, to generate noise and vibration during rotating the drum.

DISCLOSURE OF INVENTION

An object of the present invention designed to solve the foregoing problems is to provide a drum for a washer and a dryer, which can prevent vibration and noise from occurring.

The object of the present invention can be achieved by providing a drum for a washer and a dryer including a cylindrical metal body part, reduced parts at opposite end parts of the body part, each having a diameter smaller than a diameter of the body part, and bent parts each having a folded edge of the reduced part.

The reduced part includes the opposite end part of the body part having a diameter thereof reduced by pressing. The drum further includes a connection part between the body part and the reduced part having a diameter reduced, continuously.

The cylindrical body is form by rolling metal sheet and butt welding a seam. The butt welding is made except predetermined lengths of opposite edges of the seam in a length direction for forming the bent parts.

The metal cylinder has a thickness of 0.5~0.8 mm. More preferably, the metal cylinder has a thickness of 0.55~0.7 mm. A ratio of an inside diameter of the body part to the inside diameter of the reduced part is equal to, or greater than 0.9. More preferably, the ratio of an inside diameter of the body part to the inside diameter of the reduced part is 0.93~0.94. Moreover, a difference of depths between an outside diameter of the body part adjacent to the reduced part and an outside diameter of the reduced part is below 25 mm.

The metal cylinder is zinc plated. The metal is stainless steel STS. The metal may be EGI (Electrolytic Zinc Coated Steel, SECC). The metal may be GI (Hot Dip Zinc Coated Steel, SGCC). The metal may be Galvanneld steel. The metal may be Galvalume GL. The metal may be Alstar. The metal may be Alcostar. The metal may be SFCH. The metal may be SGCH.

The metal cylinder includes a painted surface. The drum further includes anti-vibration band wound on an outside surface of the body part for absorbing vibration. The anti-vibration band is formed of rubber. The anti-vibration band may be formed of metal.

The bead is formed by pressing the body part inwardly at a predetermined depth along a circumferential direction of the body part by pressing.

In other aspect of the present invention, there is provided a drum for a washer and a dryer including a body part formed by rolling metal sheet into a cylinder, and butt welding a seam, having beads formed in a surface for strengthening, connection parts having diameters reduced continuously from opposite sides of the body part by pressing respectively, reduced parts formed at opposite end parts of the body part extended from one ends of the connection parts by pressing respectively, each having a diameter smaller than a diameter of the body part, and bent parts each having a folded edge of the reduced part.

In another aspect of the present invention, there is provided a drum for a washer and a dryer including a body part formed by rolling metal sheet into a cylinder, and butt welding a seam, having beads formed in a surface for strengthening, reduced parts formed by reducing diameters of opposite end parts of the body part by pressing, bent parts each having a folded edge of the reduced part, and an anti-vibration band wound on an outside surface of the body part for absorbing vibration.

In further aspect of the present invention, there is provided a drum for a washer and a dryer including a body part formed by rolling metal sheet into a cylinder, and butt welding a seam, reduced parts formed by reducing diameters of opposite end parts of the body part by pressing, bent parts each having a folded edge of the reduced part, and an anti-vibration band wound on an outside surface of the body part for absorbing vibration.

BRIEF DESCRIPTION OF DRAWINGS

The accompanying drawings, which are included to provide a further understanding of the invention, illustrate embodiments of the invention.

In the drawings.

BEST MODE FOR CARRYING OUT THE INVENTION

Reference will now be made in detail to the preferred embodiments of the present invention, examples of which are illustrated in the accompanying drawings FIGS. 3~7. In describing the embodiments, identical parts will be given the same names and reference symbols, and repetitive description of which will be omitted.

Figure 1:
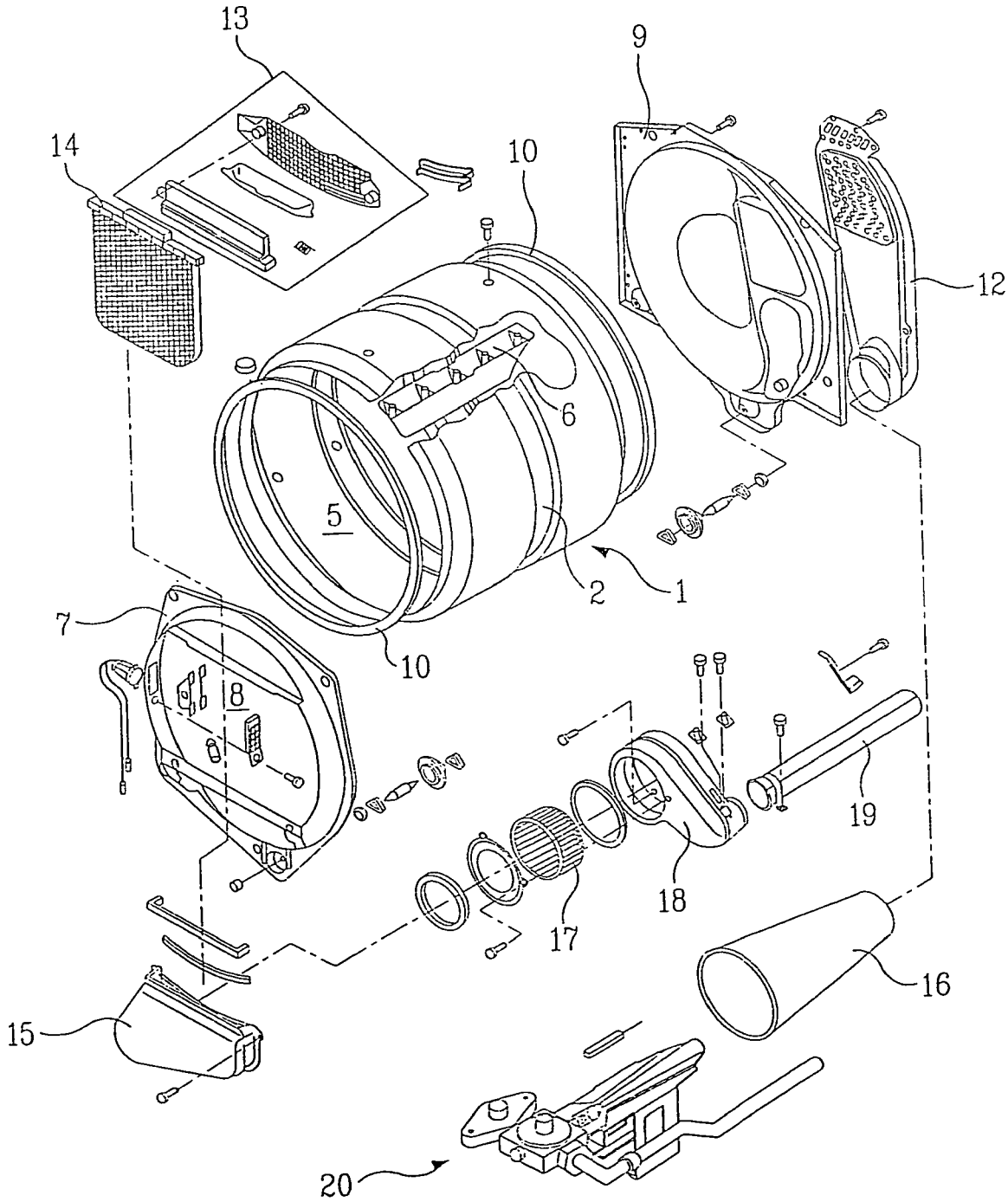
FIG. 1 illustrates a disassembled perspective view of a related art dryer.
Figure 2:
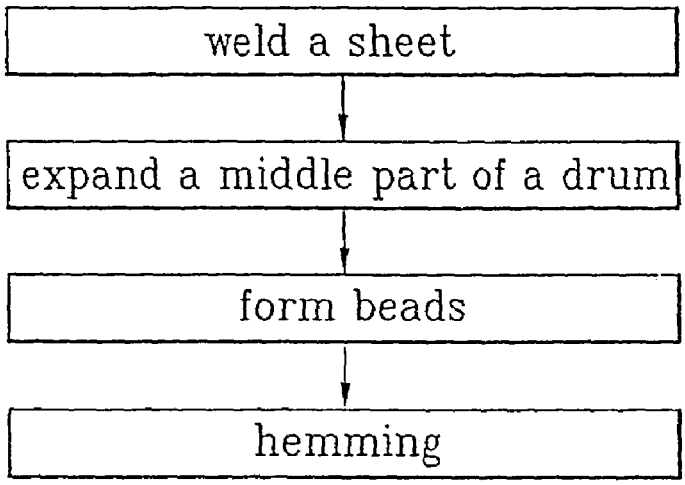
FIG. 2 illustrates a block diagram showing the steps of a related art method of fabricating a drum.
Figure 3:
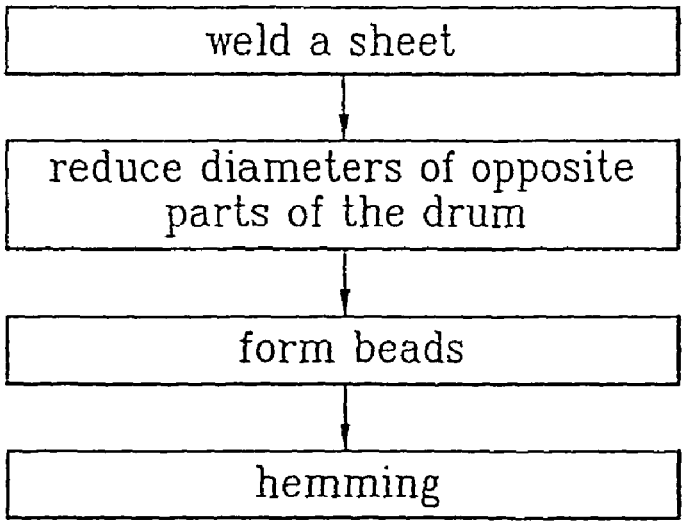
FIG. 3 illustrates a block diagram showing the steps of a method of fabricating a drum in accordance with a preferred embodiment of the present invention.
Figure 4:
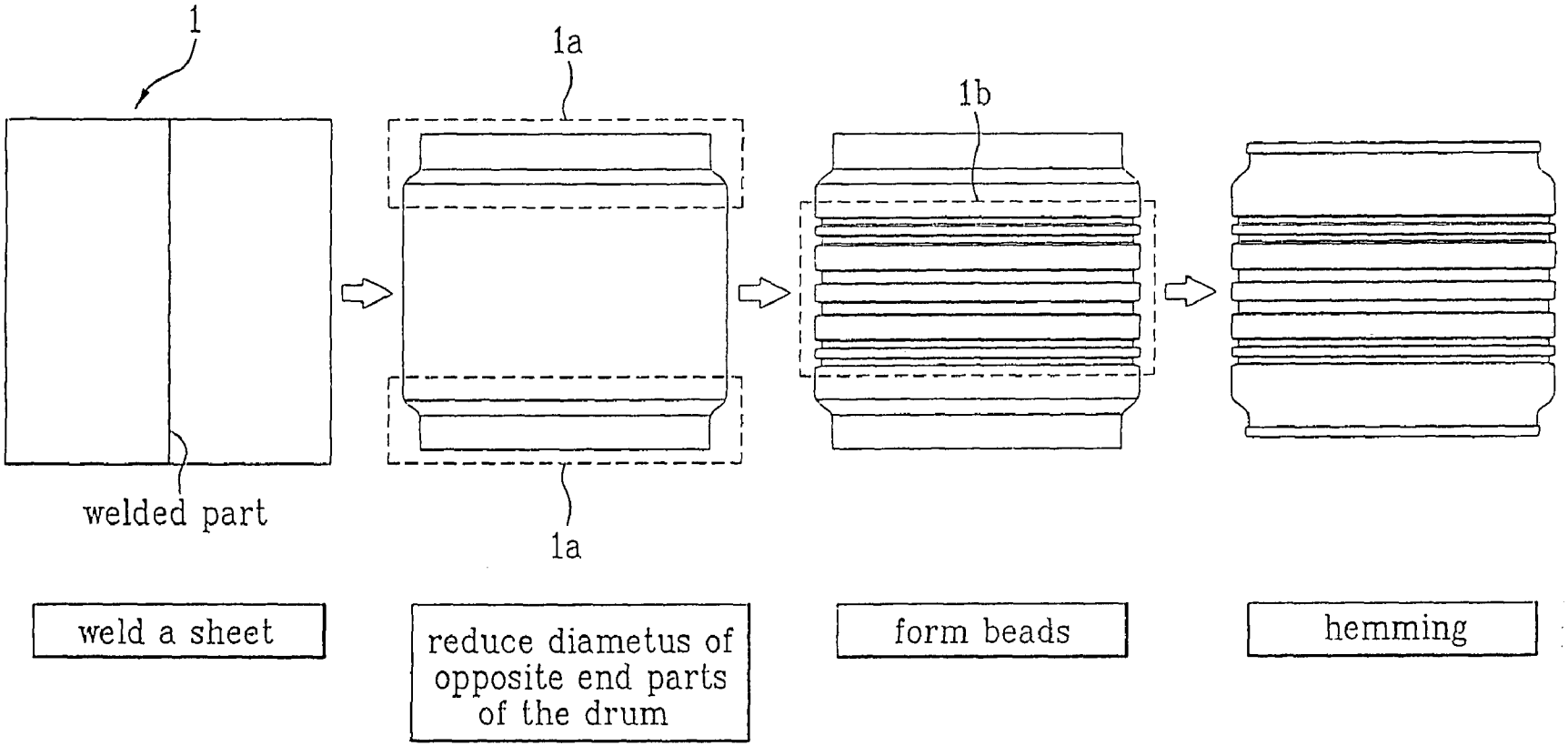
FIG. 4 illustrates a diagram showing states of a drum in the steps of the method for fabricating a drum of FIG. 3.

FIG. 3 illustrates a block diagram showing the steps of a method of fabricating a drum in accordance with a preferred embodiment of the present invention, and FIG. 4 illustrates a diagram showing states of a drum in the steps of the method for fabricating a drum of FIG. 3.

Referring to FIG. 3 and FIG. 4, the method for fabricating a drum according includes the steps of forming a cylindrical drum 1, reducing diameters of opposite ends 1*a* of the drum 1, forming beads, and bending opposite edges 1*b* of the drum 1.

In the step of forming the drum 1, a metal sheet of, such as stainless steel, is rolled into a cylinder, and a seam where opposite edges thereof abut is welded. That is, the seam is butt-welded with a plasma-TIG welder.

In the step of forming the beads 1*b*, a plurality of beads 1*b* are formed along a circumferential direction in a middle part of the drum 1 for strengthening the drum 1. The beads 1*b* are formed along the circumferential direction in depressed forms by pressing the outside circumferential surface of the drum 1 with rollers 70 while rotating the drum 1.

In the step of bending, opposite edges 1*b* of the drum 1 are bent to fold bent portions.

Meanwhile, in the method of fabricating a drum of the present invention, the middle part of the drum 1 is not expanded, but diameters of opposite end parts of the drum 1 is reduced. That is, dies are provided to an inside and outside circumferential surfaces of the top end part and the bottom end part of the drum 1, and the top end part and the bottom end part of the drum 1 is inserted and pressed between the dies, to reduce the diameters.

The middle part of the drum is not expanded, but the diameters of opposite end part thereof are reduced under the following reason.

In general, a drum formed by rolling metal sheet into a cylinder, and welding a seam has a radius not consistent along a circumferential direction. Therefore, if the middle part of the drum is expanded with the dies pressed onto the inside circumferential surface of the drum like in the related art, expanded amounts vary with positions. That is, since the amount of expansion at a position with a small diameter is large, and the amount of expansion at a position with a large diameter is small, discontinuous traces of the expansion are remained at boundaries of respective positions.

Moreover, due to a difference of the amounts of the expansion, the drum becomes to have a discontinuous form, and radiuses of the drum in the middle part of the drum vary with positions along the circumferential direction.

As described before, the failure in formation of exact cylinder with a consequential non-uniformity of rotation inertia in the related art causes vibration and noise during rotation of the drum. Therefore, for solving the problem, the present invention suggests not expanding the middle part of the drum, but reducing opposite end parts of the drum.

A method of fabricating a drum 1 in accordance with a preferred embodiment of the present invention will be described in relation to a forming device.

Figure 5:
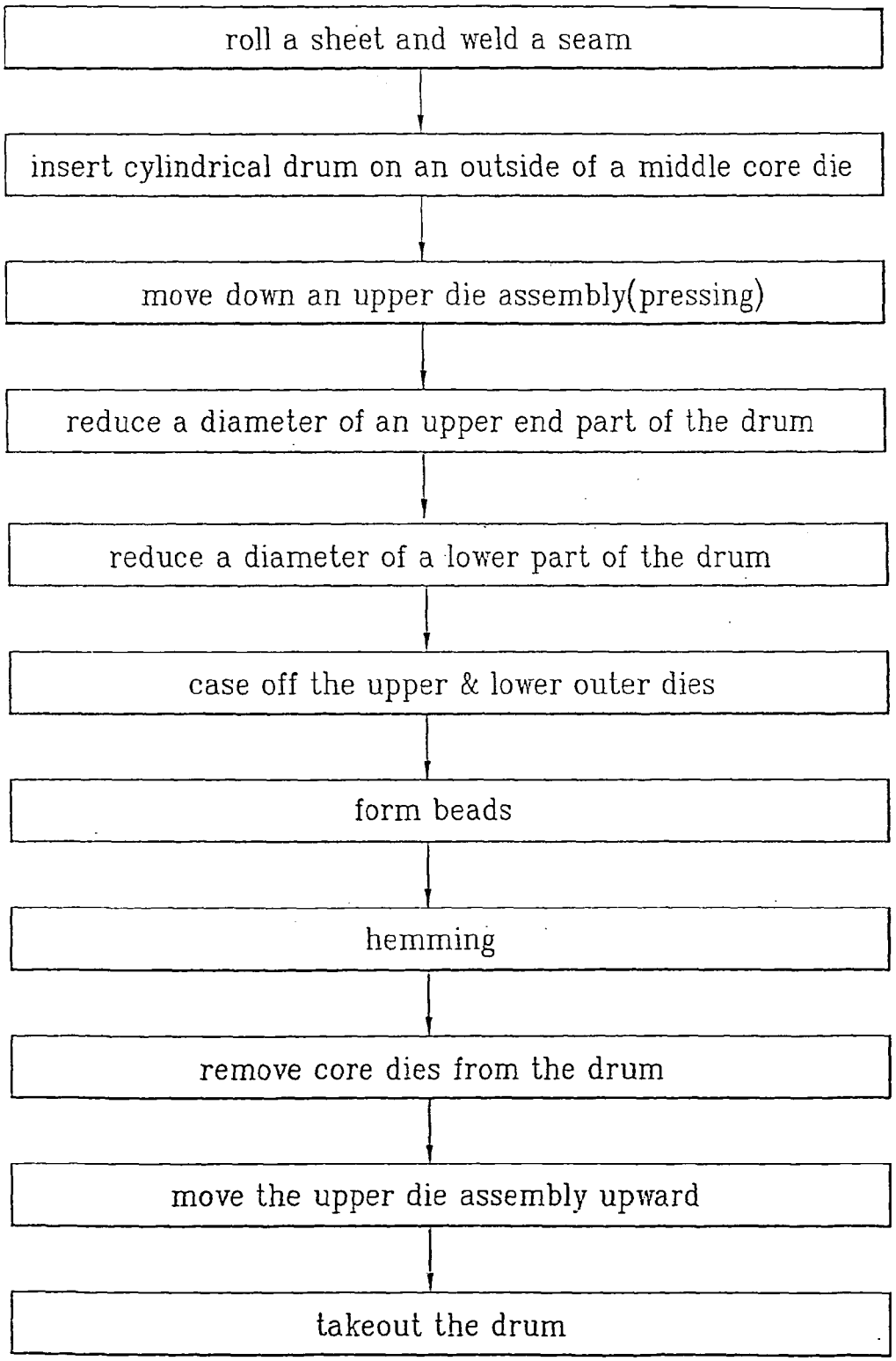
FIG. 5 illustrates a block diagram showing the steps of a method of fabricating a drum in accordance with a preferred embodiment of the present invention, in more detail.

FIG. 5 illustrates a block diagram showing the steps of a method of fabricating a drum in accordance with a preferred embodiment of the present invention, in more detail, and FIGS. 6A to 6H illustrate structures of the drum and the dies as the steps of a method for fabricating a drum is progresses.

Figure 6A:
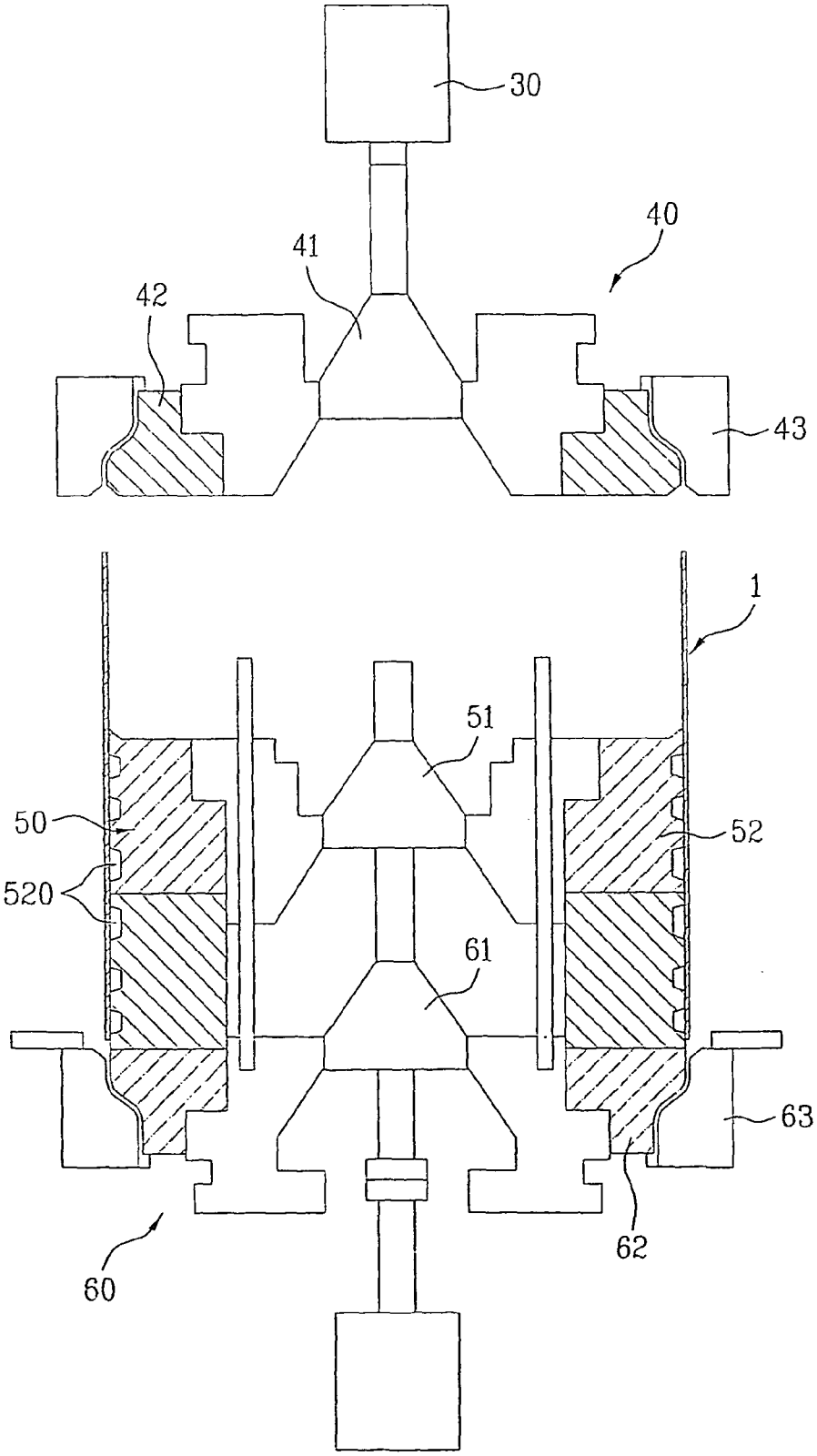
FIGS. 6A to 6H illustrate structures of the drum and the dies as the steps of a method for fabricating a drum is progresses.

Referring to FIG. 6A, the device for forming a drum includes an upper die assembly 40, a lower die assembly 60, a middle die assembly 50, and a press (not shown).

The upper die assembly 40 includes a motor 30, an upper cam 41, an upper core die 42, and an upper outer die 43. The upper die assembly 40 is pressed with the press.

The upper cam 41 is connected to a rotation axis of the motor 30, and the upper core die 49 can be expanded or contracted in a radial direction along the upper cam 41. The upper outer die 43 is at an outer side of the upper core die 42 to be movable in up and down direction, independently.

Meanwhile, the middle die assembly 50 includes a middle cam 51 and a middle core die. The middle cam 51 is in line with the rotation axis of the motor 30, and the middle core die 52 can be expanded or contracted in a radial direction along the middle cam 51.

The lower die assembly 60 has the same system as the upper die assembly 40, and is positioned opposite to the upper die assembly 40. That is, the lower die assembly 60 includes a lower cam 61, a lower core die 62, and a lower outer die 63.

The lower cam 61 is mounted on a shaft passed through the middle core die 52, and the lower core die 62 can be expanded or contracted in a radial direction along the lower cam 61. The lower outer die 63 is at an outer side of the lower core die 62 to be movable in up and down direction, independently.

The core dies 42, 52 and 62 are cylindrical on the whole each for being in contact with an inside circumferential surface of the drum 1, and are split in a radial direction at predetermined angular intervals for expansion or contraction in the radial direction.

The radial direction expansion and contraction of the core dies 42, 52 and 62 will be described. FIG. 6A illustrates a state the core dies 42, 52 and 62 are expanded in the radial direction, to be in contact with the inside circumferential surface of the drum 1. An inside of each of the core dies is sloped.

Figure 6B:
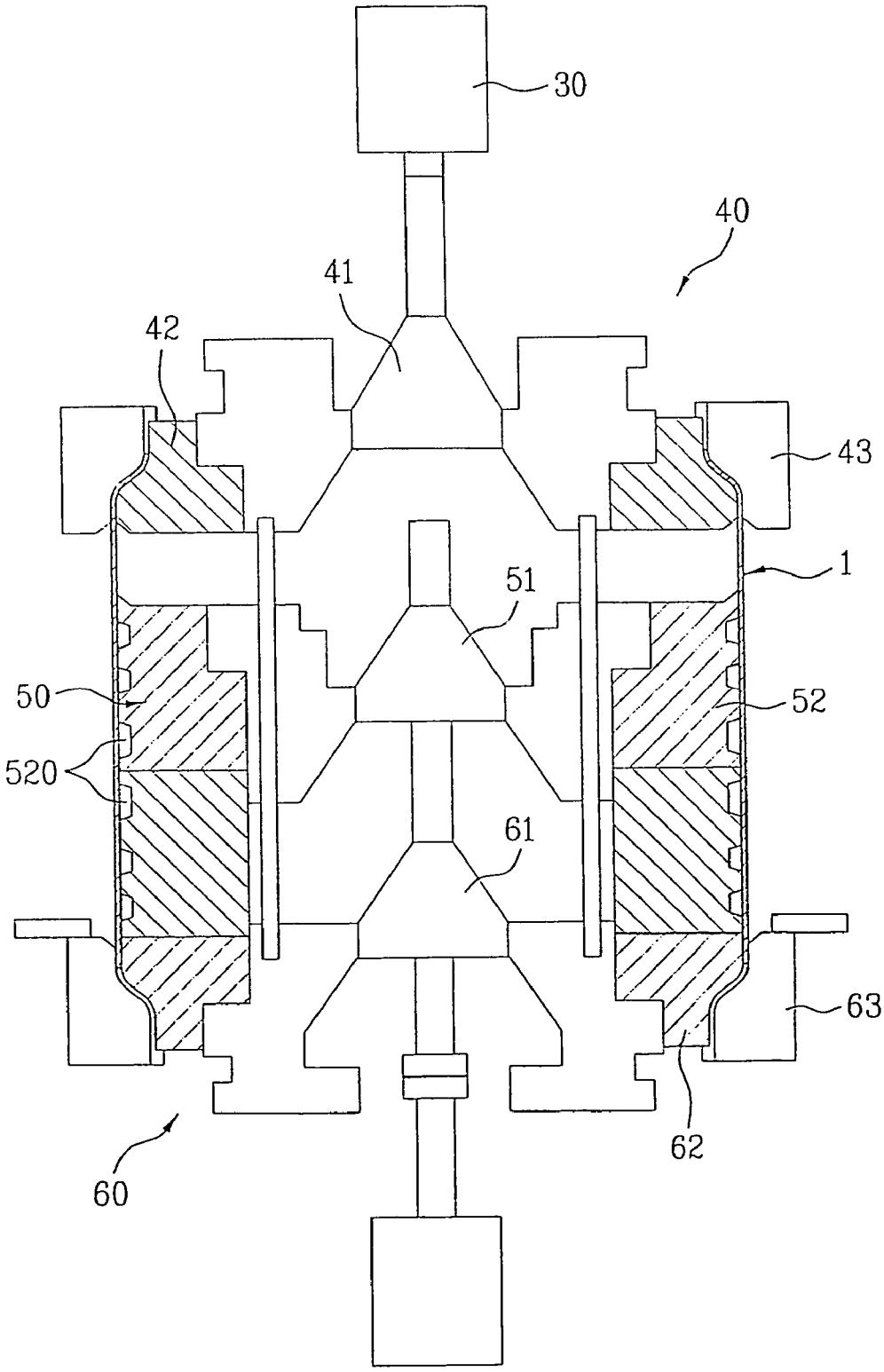
Figure 6C:
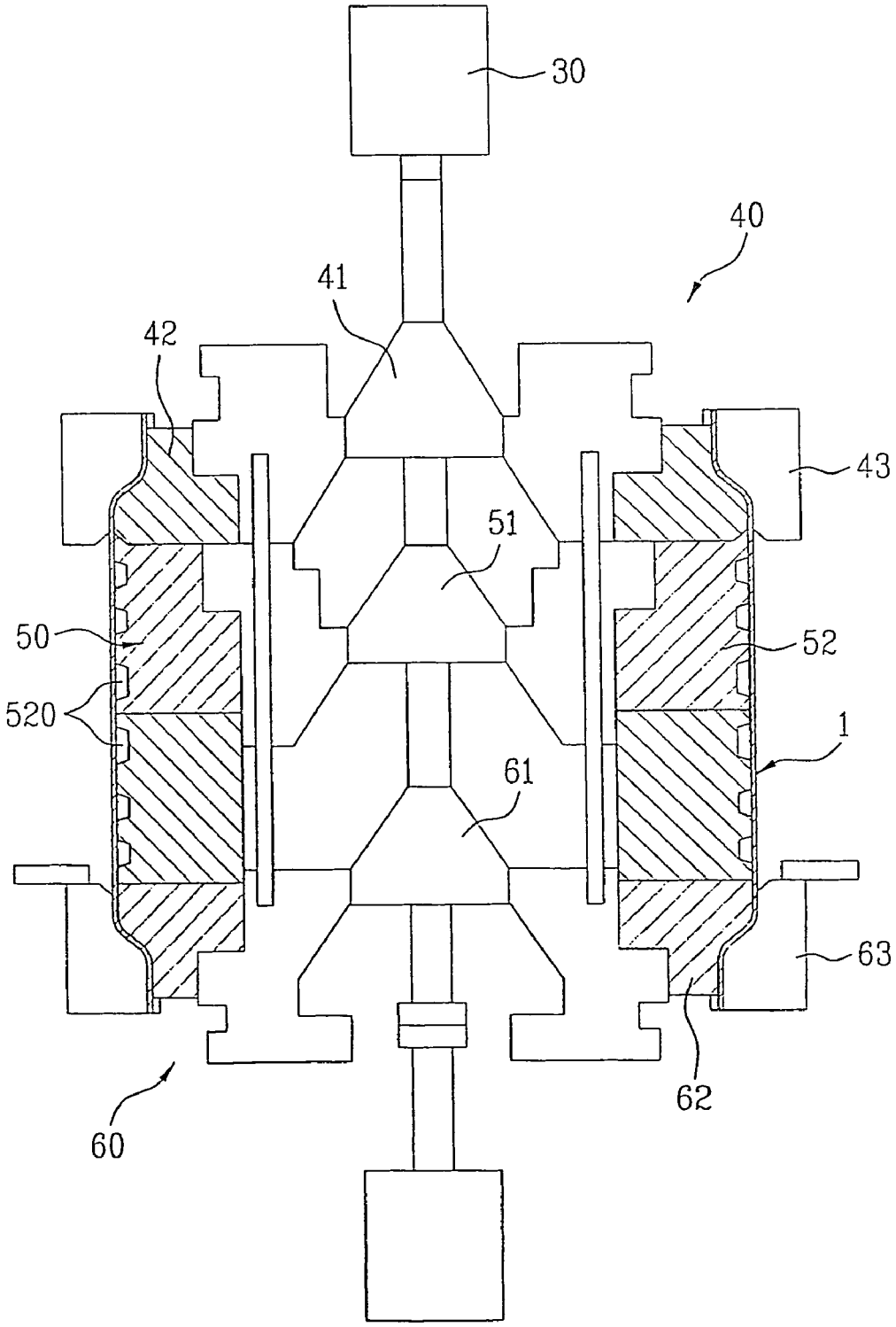
Figure 6D:
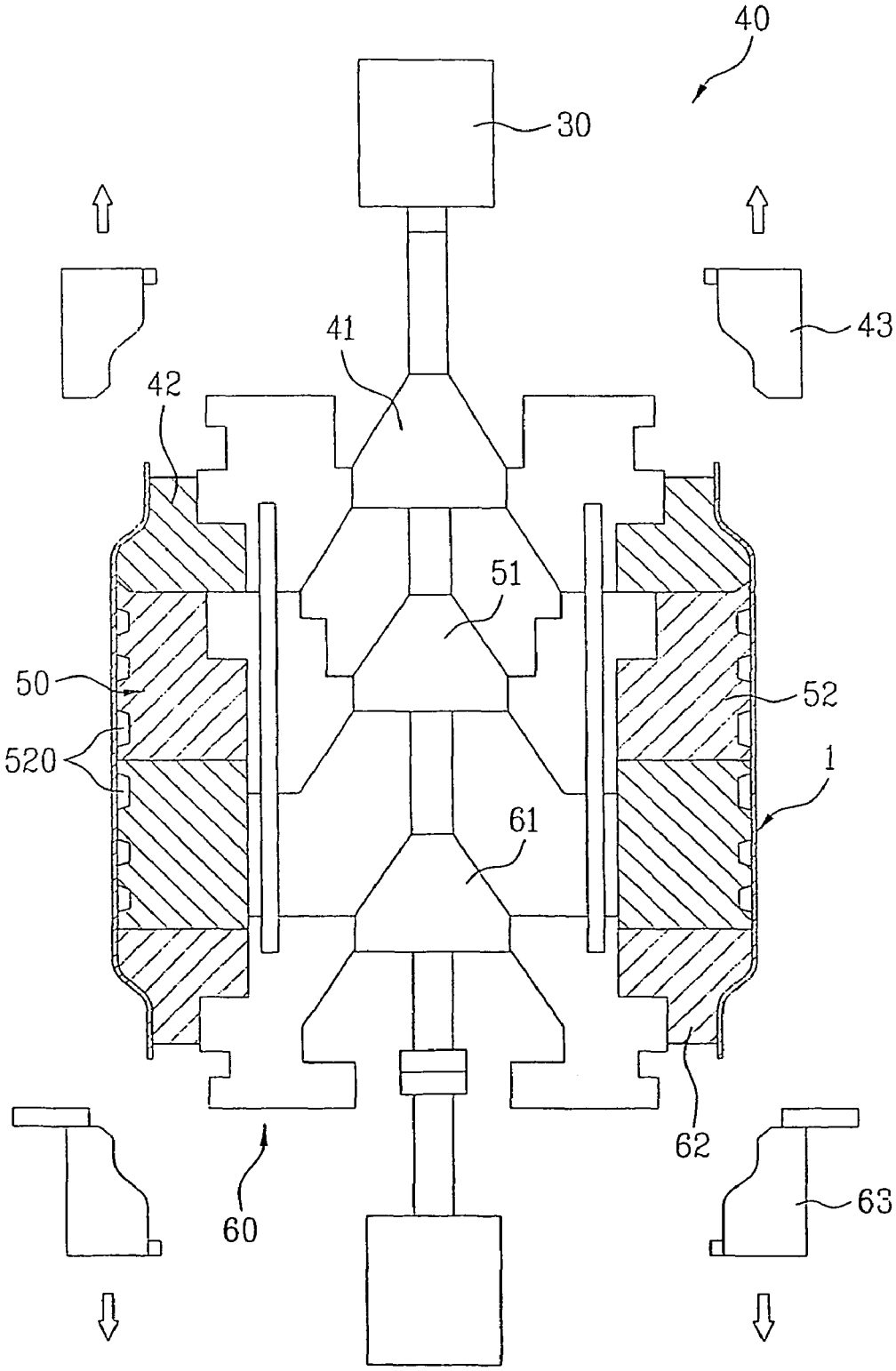
Figure 6E:
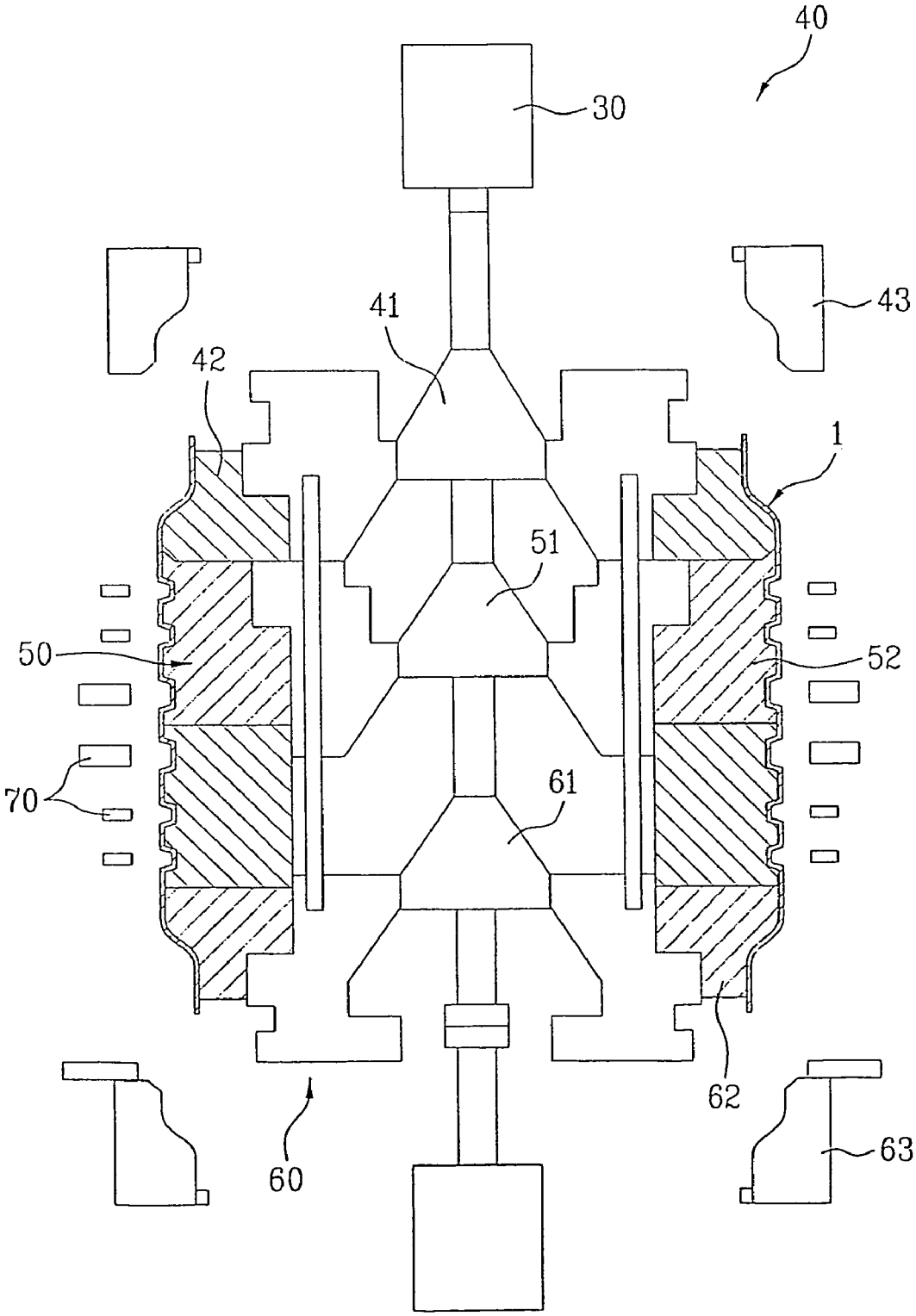
Figure 6F:
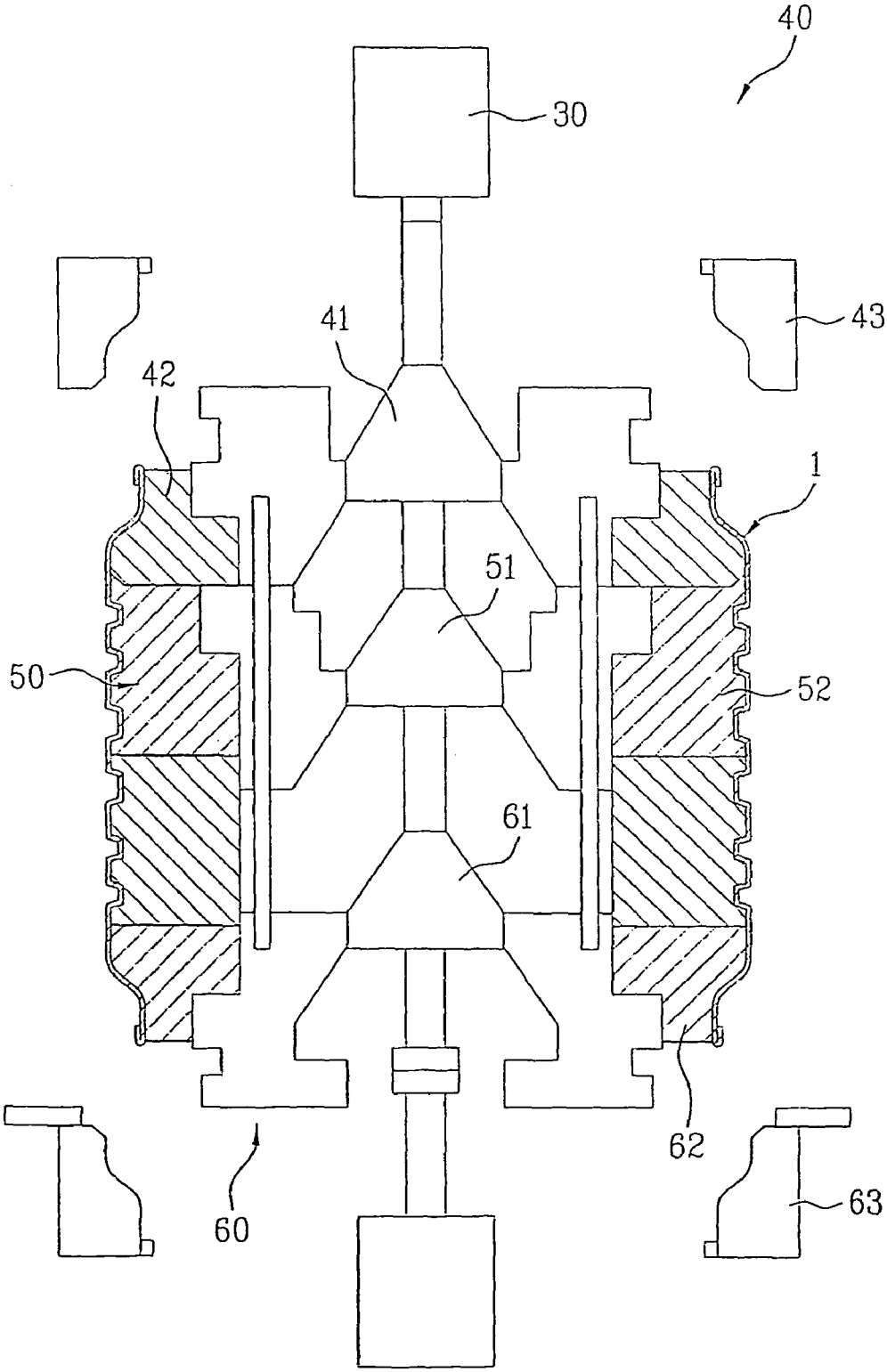
Figure 6G:
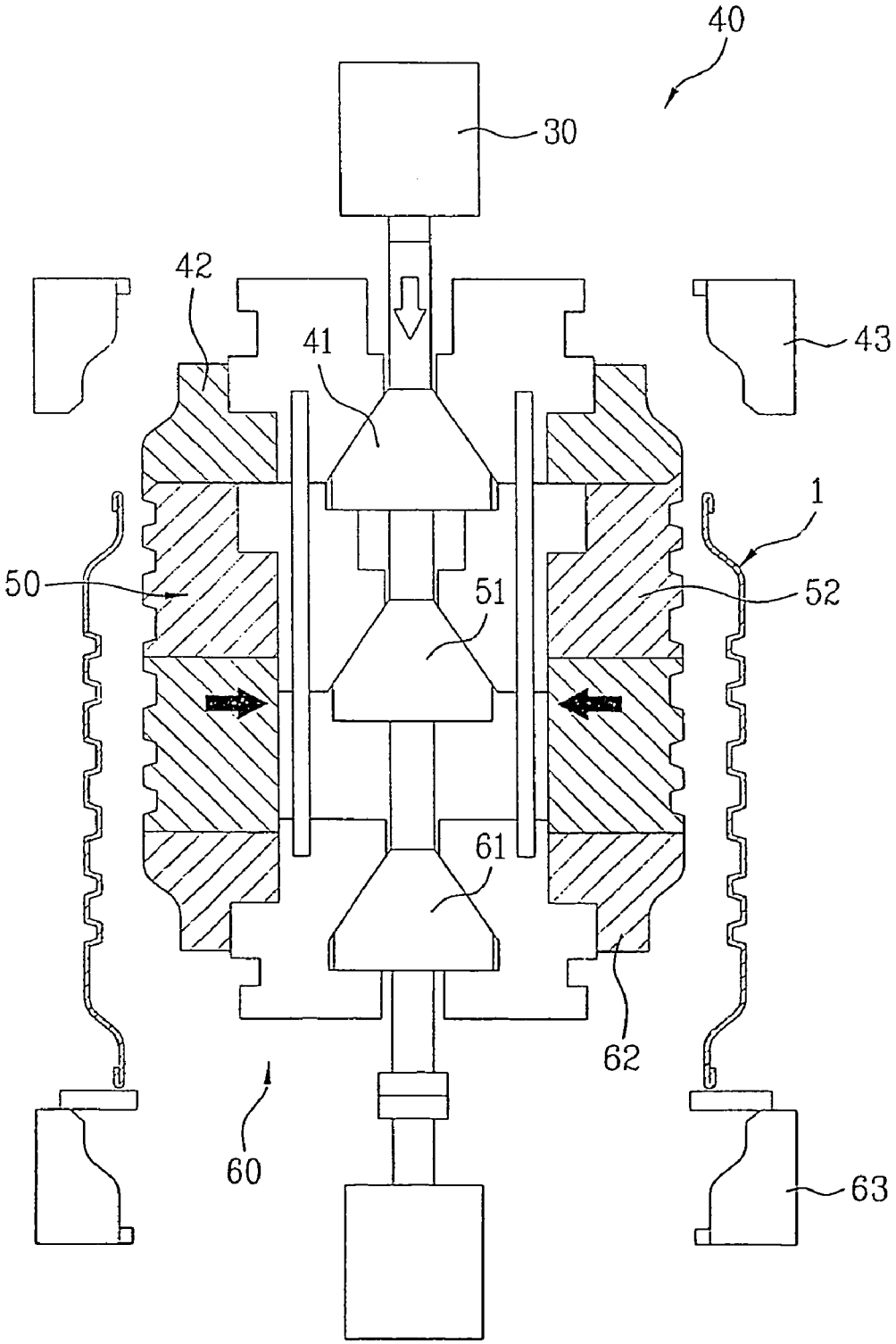

FIG. 6G illustrates a state the core dies 42, 52 and 62 are contracted in the radial direction as the cam 41, 51, and 61 slide. That is, as the shaft having the cams mounted thereon moves up/down, the cams slide along the slope, to expand/contract the core dies.

A method for fabricating a drum by using a drum forming device will be described with reference to FIGS. 6A~6H. FIG. 6A illustrates a drum before opposite end parts thereof are contracted.

Referring to FIG. 6A, a cylindrical drum 1 is loaded on the drum forming device by inserting the drum 1 on an outside of the middle core dies 52 of the drum forming device. The cylindrical drum 1 is fabricated by rolling metal sheet and welding a seam thereof.

The cylindrical drum 1 inserted on the outside of the middle core die 52 is held by the middle core die 52 and the lower core die 62, and the upper core die 42 is not moved down.

FIG. 6B illustrates the step of reducing a diameter of an upper end part of the drum as the upper die assembly is moved downward.

After loading the cylindrical drum 1 on the outside of the core dies in the device for forming the drum, the upper core assembly 40 is pressed downward by the press (not shown). In this instance, the upper end part of the drum 1 is inserted between the upper core die 42 and the upper outer die 43, involving deformation in a form of reducing a diameter of the drum 1.

FIG. 6C illustrates a state the step of reducing diameters of the upper and lower end parts of the drum is progressed.

Referring to FIG. 6C, even after the diameter reduction of the upper end part of the drum 1 is finished, the upper die assembly 40 keeps moving down, when the lower end part of the drum 1 is inserted between the lower core die 62 and the lower outer die 63, finishing the diameter reduction of the lower end part of the drum 1.

Subsequently, as shown in FIG. 6D, after completion of reduction of diameters of the lower and upper end parts of the drum 1, the upper outer die 43 is moved upward, and the lower outer die 63 is moved downward, to cast off respective outer dies.

FIG. 6E illustrates the step of forming beads in a middle part of the drum.

Following driving of the motor 30, the core dies are rotated, and the rollers 70 on an outside of the drum 1 are moved to respective grooves (520 in FIG. 6D) in the core die 52, and press an outside circumferential surface of the drum 1. In this instance, since parts of the drum pressed by the rollers 70 are deformed according to forms of the grooves 520, the beads are formed.

Then, as shown in FIG. 6F, opposite edges of the drum 1 are folded, i.e., hemmed.

FIG. 6G illustrates a state the core die is contracted to cast off the drum. In this instance, the core dies 42, 52 and 62 are contracted in an arrow direction, to cast off the drum 1. Accordingly, as interference between the drum 1 and the core dies are prevented, the drum 1 can be moved out of the core dies. Meanwhile, before the core dies are contracted, the lower outer die 63 is moved to a position at which the lower outer die 63 can support a bottom end of the drum 1.

Figure 6H:
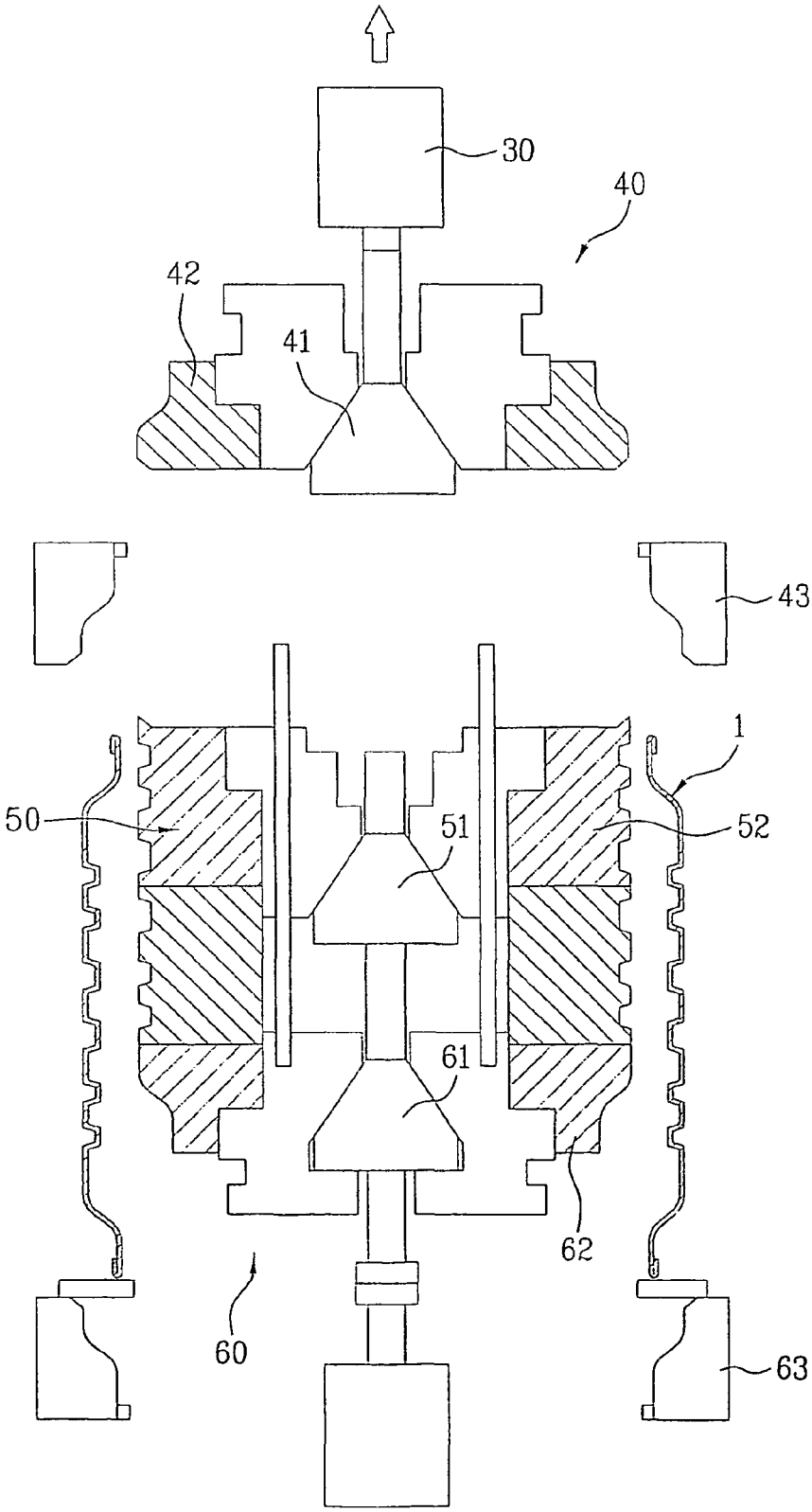

FIG. 6H illustrates a state after the upper die assembly is moved up.

When the upper die assembly 40 is moved up, it is possible to avoid interference between the drum and the device for forming the drum in the upper part. Thus, the drum can be taken out of the device for forming the drum.

Figure 7:
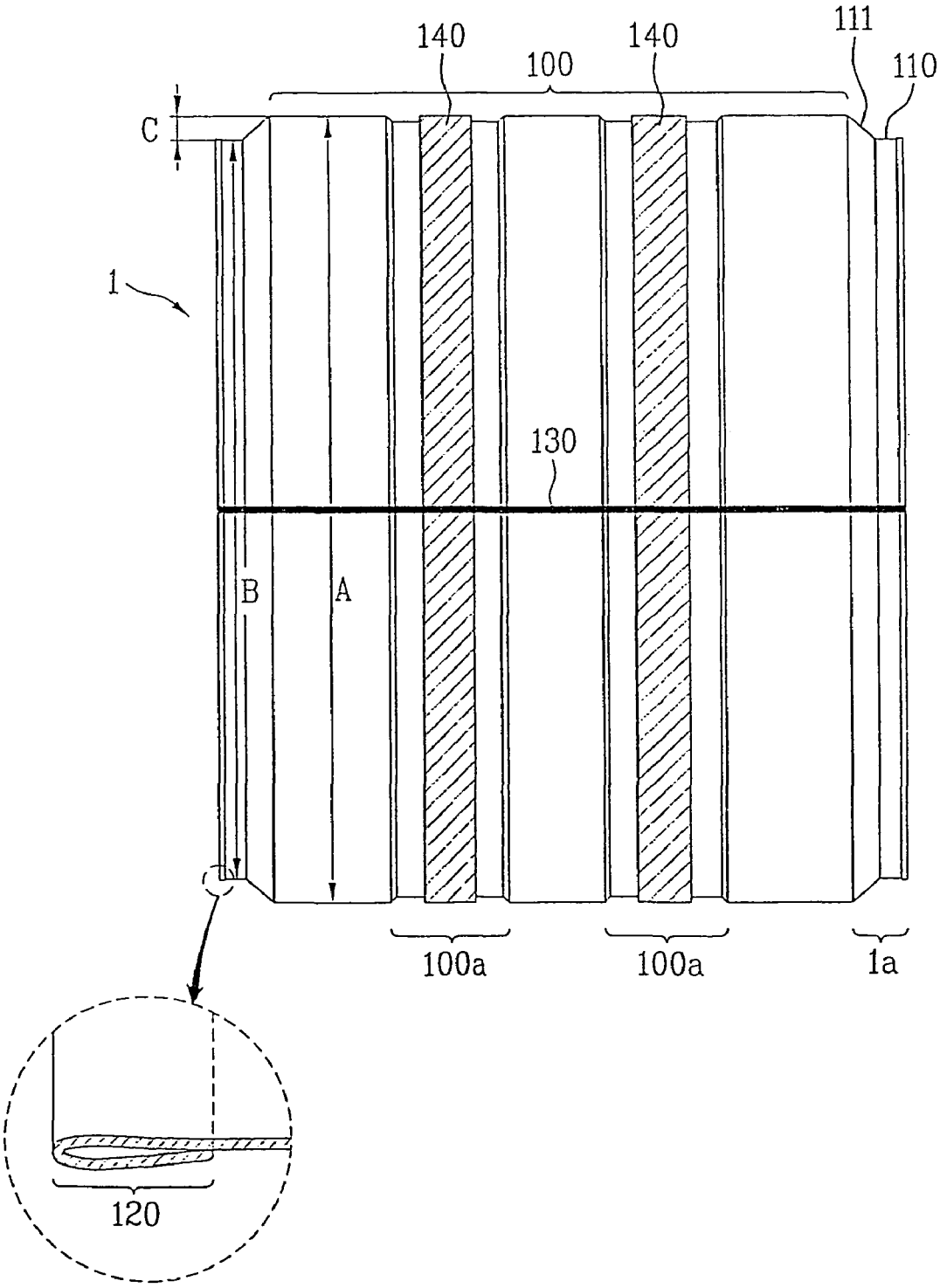
FIG. 7 illustrates a front view of a finished drum by the method for fabricating a drum of the present invention.

FIG. 7 illustrates a front view of a finished drum by the method for fabricating a drum of the present invention.

Referring to FIG. 7, the drum 1 includes a body part 100, reduced parts 110, and bent parts 120. The body part is a metal cylinder, with beads 100*a* in a surface thereof or strengthening. The bead 100*a* is an inwardly recessed part along a circumferential direction of the body part 100. The reduced parts 110 are at opposite edges 1*a* of the body part 100 each with a diameter smaller than a diameter of the body part 100. The bent part 120 is a part where an edge of the reduced part 110 is folded.

The bead 120 is formed by pressing the body part 100 inwardly at a redetermined depth along a circumferential direction of the body part 100 by pressing. It is preferable that there is at least one bead 120.

The reduced parts 110 are opposite end parts of the body part 100 having diameters contracted by pressing. That is, instead of expanding a diameter of the middle part of the drum 1, diameters of the opposite end parts of the drum 1 are reduced, so that a section of the drum 1 has a more consistent and accurate circular form.

Referring to FIG. 7, there is a connection part 111 between the reduced part 110 and the body part 100 having a diameter reduced continuously. The connection part 111 is provided for preventing the body part 100 from breaking due to a sharp reduction of the diameter during pressing.

The connection part 111 has the reduced part 110 formed at one end having a reduced diameter, and the reduced part 110 is joined with the front support or the rear support of the dryer.

The metal cylinder is provided by rolling metal sheet into a cylinder, and butt welding a seam 130 thereof with a plasma-TIG welder in a state opposite edges are not overlapped. This is because, if the opposite edges are overlapped at the seam 130, no uniform deformation can be secured at the overlapped part in the contraction or expansion.

Predetermined lengths of the opposite edges of the seam as much as to be bent are not welded for forming the bent parts at the opposite edges.

In the meantime, the metal cylinder has a thickness of 0.5~0.8 mm, and, more preferably, 0.55~0.7 mm. A thickness thinner than 0.5 mm is liable to tear during the contraction or expansion of the diameter of the cylinder. Moreover, metal buttons or the like attached to laundry under drying may hit the inside wall of the drum, to produce a loud noise.

Opposite to this, if the thickness is thicker than 0.8 mm, a material cost rises, and a great force of the press is required for forming the diameter of the cylinder. Moreover, mounting of the heavy drum on the cabinet is difficult, and even after the mounting, a great load is applied to the roller supporting the drum.

In the meantime, a ratio B/A of an inside diameter of the body part 100 to an inside diameter of the reduced part 110 is greater than 0.9, and more preferably 0.93~0.94.

In order to increase a volume of the drum 1 within a limited capacity of an inside of the cabinet taking a relation between the reduced parts 110 and the front support/rear support, it is required to reduce diameters of the reduced part 110 more than certain lengths.

Since the forming for reducing the diameters of opposite edges of the drum 1 uses ductility of metal, the forming is limited by the thickness of the drum 1, and the inside diameter ratio B/A is an optimal ratio suggested for accurate forming at above thickness of the drum 1.

The metal cylinder is prevented from tearing when the inside diameter ratio B/A is greater than 0.9 at the thickness of the metal optimized by experiment. An optimal range of the inside diameter ratio taking safety into account is 0.93~0.94. The inside diameter ratio is almost same with a radio of a diameter of the reduced part 110 to a diameter of the body part 100 (an outside diameter ratio).

As one preferred embodiment of the present invention, in a case the thickness of the cylinder is 0.5 mm, an outside diameter of the body part 100 is 663 mm, and an outside diameter of the reduced part is 616~623 mm, with a difference of outside diameters of the body part 100 and the reduced part 110 being 40~47 mm a depth C from an outside surface of the body part 100 to an outside surface of the reduced part 110 is 20~23.5 mm.

In a case the thickness of the cylinder is 0.5 mm, the outside diameter of the body part 100 is 663 mm, and a ratio of the inside diameter of the body part 100 to the inside diameter of the reduced part is 0.9, with a difference of outside diameters of the body part 100 and the reduced part 110 being 67 mm, the depth C from an outside surface of the body part 100 to an outside surface of the reduced part 110 is 33.5 mm. If the depth is greater than 33.5 mm, the cylinder is liable to tear during the formation.

If a safety required for avoiding damage during assembly, it is preferable that the depth C from the outside surface of the body part 100 to the outside surface of the reduced part 110 is maintained to be below 25 mm.

In the meantime, as other preferred embodiment of the present invention, if the cylinder has a thickness of 0.6 mm, it is preferable that the depth is around 44 mm.

There is anti-vibration band 140 wound on the outside surface of the body part 100 or on the beads 100*a*. The anti-vibration band 140 absorbs or reduces noise and vibration caused by laundry in the drum 1. The anti-vibration band 140 is rubber or metal, and tightly attached to the outside surface of the body part 100 or the beads 100*a*.

It is preferable that the drum 1 is formed of stainless steel STS having a good strength and a glossy exterior. Or, alternatively, the drum 1 may be formed of Alstar or Alcostar, having a good corrosion resistance, and a comparatively low cost.

That is, in view of improvement of exterior, the stainless steel is favorable, and in view of corrosion or cost, Alstar or Alcostar is favorable.

Besides, it is preferable that the drum 1 may be formed of EGI (Electrolytic Zinc Coated Steel. SECC), GI (Hot Dip Zinc Coated Steel, SGCC), Galvanneld steel, Galvalume (GL), SFCH, or SGCH.

Moreover, it is preferable that zinc is plated on the surface of the metal cylinder, or a painting layer is formed.

In the meantime, the drum is applicable not only to the dryer, but also to a washer.

INDUSTRIAL APPLICABILITY

The drum for a washer and a dryer of the present invention has the following advantages.

The drum of the present invention is formed, not by expanding a middle part of the drum, but contracting opposite end parts of the drum. According to this, the pressing trace of core dies on the middle part of the drum 1 which is harmful to an outer appearance of the drum is eliminated. Moreover, by not pressing the middle part of the drum 1, the circular form of the middle part of the drum is not impaired. According to this, the drum fabricated according to the present invention has a continuous form, and can minimize vibration and noise during rotation.

As has been described, the present invention improves a method for fabricating a drum for a dryer, to maintain an overall circular form of the drum, and to improve reliability of the dryer.

Though the present invention has been described taking a drum for a dryer as an example, the present invention can be applied to a drum for washer or the like.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A dryer comprising:

a drum comprising:

a cylindrical metal body having a first diameter and a seam without an overlapping portion by butt welding, wherein the first diameter is not expanded;

end portions located at opposite ends of the cylindrical metal body, wherein the end portions have a second diameter smaller than the first diameter; and folds having a folded edge at the end portions.

2. The dryer as claimed in claim 1, wherein the reduced part includes the opposite end part of the body part having a diameter thereof reduced by pressing.

3. The dryer as in claim 1, further comprising a connection part between the body part and the reduced part having a diameter reduced continuously.

4. The dryer as claimed in claim 1, wherein the cylindrical body is formed by rolling a metal sheet and butt welding a seam.

5. The dryer as claimed in claim 4, wherein the butt welding is made except predetermined lengths of opposite edges of the seam in a length direction for forming the bent parts.

6. The dryer as claimed in claim 1, wherein a ratio of an inside diameter of the body part to the inside diameter of the reduced part is equal to, or greater than 0.9.

7. The dryer as claimed in claim 1, wherein a difference of depths between an outside diameter of the body part adjacent to the reduced part and an outside diameter of the reduced part is below 25 mm.

8. The dryer as claimed in claim 1 wherein the bead is formed by pressing the body part inwardly at a predetermined depth along a circumferential direction of the body part by pressing.

9. A dryer comprising:

a drum comprising:

a body part formed by rolling a metal sheet into a cylinder, and butt welding a seam without an overlapping portion, having beads formed in a surface for strengthening; the connection parts having diameters reduced continuously from opposite sides of the body part by pressing, respectively;

reduced parts formed at opposite end parts of the body part, extended from one end of the connection parts by pressing respectively, each having a diameter smaller than a diameter of the body part; and bent parts each having a folded edge of the reduced part.

* * * * *